US005313723A

United States Patent [19]

Cregg

[11] Patent Number: 5,313,723

[45] Date of Patent: May 24, 1994

[54] PERPETUAL CALENDAR

[76] Inventor: Scott A. Cregg, P.O. Box 127, Brewster, Kans. 67732

[21] Appl. No.: 2,169

[22] Filed: Jan. 8, 1993

[51] Int. Cl.[5] ..... G09D 3/08

[52] U.S. Cl. ..... 40/113; 40/107; 40/115; 116/309; 283/2

[58] Field of Search ..... 40/107, 113, 115; 116/309; 282/2

[56] References Cited

U.S. PATENT DOCUMENTS

| | | | |
|---|---|---|---|
| 548,461 | 10/1895 | Robinson | 40/642 |
| 2,248,591 | 7/1941 | Sow | 40/113 |
| 2,952,932 | 9/1960 | Beer | 40/113 |
| 3,468,049 | 9/1969 | Benson . | |

OTHER PUBLICATIONS

"Ingenious Calendar—40 Year Perpetual Calendar" Sawyers Catalog No. 3, Avon Products, N.Y.—1 Sheet (Date Unknown).

*Primary Examiner*—Clifford D. Crowder
*Assistant Examiner*—Gloria Hale

[57] ABSTRACT

A calendar including a first disk and a second disk. The second disk is connected to and rotatable concentrically relative to the first disk. The first disk includes a window and indicia adjacent to the window representing the various days of the week. The first disk further includes indicia indicating various months of the year and lead lines which function as pointers. Thus, the user may select, by using the pointers, a desired year from a table or a list of a plurality of years appearing on the second disk. This configuration allows the user to easily select a predetermined year by means of a pointer. The second disk further includes a day number grid, the dates ranging from 1 to 31. When the second disk is rotated relative to the first disk, the day grid draws an orbit and the grid is located below the window of the first disk. Consequently, when a predetermined year with respect to a predetermined month is selected, the window displays a corresponding calendar month. A stand is provided for supporting the calendar. A click stop, rachet wheel and leaf spring assembly may be provided behind the second disk, for controlled, incremental movement of the second disk relative to the first disk.

17 Claims, 4 Drawing Sheets

PERPETUAL CALENDAR

BACKGROUND OF THE INVENTION

1. Field of the Invention

The present invention relates generally to calendars and in particular, to a single axis rotatable disk calendar.

2. Description of the Prior Art

The field of art to which the invention pertains is calendars. More specifically, the present invention relates to a disk calendar which is rotatable about a single axis and which through simple manipulations, can be used for a number of years. Such multi-year and perpetual calendars are known. However, most of these are complex utilizing vast arrays of numbers and symbols which require at least a moderate amount of effort to operate. At the other side of the spectrum are those calendars which are very simple to operate. Unfortunately, these simple to use calendars are not very intriguing to the user.

U.S. Pat. No. 3,468,049 issued on Sep. 23, 1969 to Benson describes a calendar showing a chronological arrangement of dates of a number of years in a sequence in which two members are provided which are mounted about a common axis constituting a center of rotation whereby the members are rotatable in relation to each other. One of the members carries a month scale consisting of twelve months of the year arranged concentrically around the center of rotation and a week day scale consisting of five weeks arranged concentrically around the center, the other of the members carrying a day date scale or table consisting of five concentric rows having a plurality of numerals arranged in a plurality of columns. The rows are arranged concentrically around the center of rotation. In addition, a year scale consisting of a predetermined number of consecutive years is also arranged substantially concentrically around the center of rotation. The year date of the year scale is visible through an opening and respective portions of the month scale and the week day scale and a portion of the day date scale constituting seven columns of the plurality of columns are visible through another opening.

Another interesting perpetual calendar is disclosed in Sawyers Catalog No. 3, Avon Products, Inc., New York, N.Y., and named "Ingenious Calendar—40 Year Perpetual Calendar." This calendar covers the years 1992–2031 and provides identification of a correct weekday for any selected date. However, the universal 31 day calendar of the device appears in an unfamiliar, awkward Tuesday through Monday format and its use is not readily apparent from a mere inspection of the device, unlike the instant invention. Furthermore, two potentially confusing arcuate openings at the top and bottom of the circular calendar are required.

The present invention eliminates the need for using such a plurality of openings as disclosed in the prior art just discussed, by having only one opening corresponding to the current calendar month arranged in a week day scale. This opening is located on a singularly smaller first disk having a window providing viewing of a calendar month. The calendar month is formed from a grid comprising seven pairs of 6×7 matrices which appear on a larger rearwardly disposed second disk. In addition, the present invention includes a table listing a plurality of years and being disposed about a peripheral edge of the second disk. The face of the first disk is provided with markings which align with corresponding markings on the second disk, to arrange a portion of the grid on the second, rotatable disk beneath the window of the first, fixed disk to form a corresponding calendar month in the window in the first disk, which may be read very easily, in familiar Sunday through Saturday, day 1 through day 31 style or fashion.

None of the above disclosures taken either singularly or in combination, is seen to describe the instant invention as claimed.

SUMMARY OF THE INVENTION

The calendar according to the present invention includes a first disk and a second disk. The second disk is connected to and rotatable concentrically relative to the first disk via a shaft. The first disk includes a window and indicia adjacent to the window. The indicia indicates each day of a week. The first disk further includes indicia indicating various months, such as January to December of a normal year, and January and February of a leap year, by which a user specifies a predetermined month. The first disk further includes a plurality of pointers or lead lines connected to corresponding months of the indicia indicating the various months. When the user specifies the predetermined month, a pointer corresponding to the predetermined month is accordingly specified. Thus, the user selects, by using the pointer, a desired year from a table or a list of a plurality of years, such as the christian era years shown.

The second disk includes the year table containing the plurality of years. The second disk is larger than the first disk, and the year table is arranged between an outer circumferential or peripheral edge of the first disk and an outer peripheral edge of the second disk. The lead lines are arranged adjacent to the outer circumference of the first disk and adjacent to the year table. This configuration allows the user to easily select a predetermined year by means of a pointer. The second disk further includes a day grid consisting of a matrix of six rows and eighty-four columns. The matrix includes fourteen submatrices with six rows and seven columns each. Dates from 1 to 31 are assigned to each submatrix. When the second disk is rotated relative to the first disk, the matrix draws an orbit and the matrix is located beneath the window of the first disk. Consequently, when the predetermined year with respect to the predetermined month is determined, the window and the indicia indicating each day of the week automatically define a calendar period. In practical use, the first disk and the second disk are supported by an A-shaped member and a inverted T-shaped member. The shaft is connected to a crossing of two oblique portions of the A-shaped member. A longitudinal portion of the inverted T-shaped member is inserted into an aperture of the A-shaped member. The two oblique portions of the A-shaped member and a traverse portion of the inverted T-shaped member rotatably support the second disk and support the first disk.

Accordingly, it is a principal object of the invention to provide a calendar which is relatively uncomplicated in its use.

It is a further object of the invention to provide a perpetual calendar with relatively movable disks, and providing a selected calendar in familiar, easily read, Sunday to Saturday, day 1 to day 31 format.

It is another object of the invention to provide a calendar having a forward most, smaller disk with a single window and markings, and a rearward most, larger disk provided with a grid comprising a repeat pattern of dates and a table listing of years.

It is a further object of the invention to provide a first set of markings on the forward most disk which correspond to a second set of markings on the rearward most disk to display a calendar month through the window in the forward most disk.

Still another object of the invention is to eliminate the need for using a plurality of openings by having only one opening corresponding to the current calendar month arranged in a week day scale.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
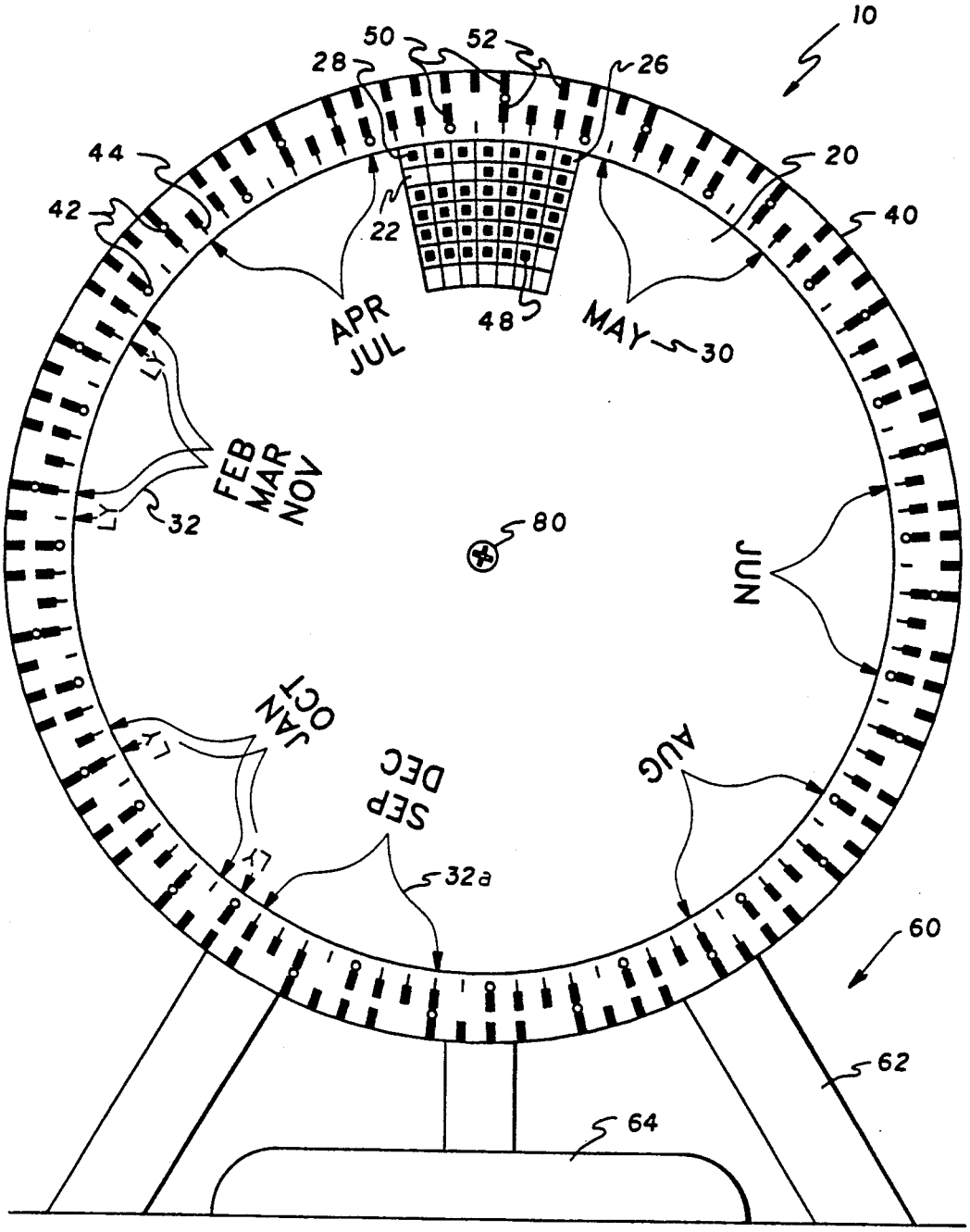
FIG. 1 is a front elevational view of the calendar according to the present invention.

Now referring to the drawings and more particularly, to FIG. 1 showing the perpetual calendar 10 comprising a first disk 20, a second disk 40, and an optional stand 60. The first disk 20 is a smaller, forward most disk having a face, a back, and a peripheral edge. The first disk 20 further includes an arcuate shaped window 22 disposed a predetermined distance from the peripheral edge. The window 22 is provided for viewing a grid 48 therethrough. The grid 48 is formed of a plurality of rows and columns. Located between the outer most peripheral edge of the window 22 and the peripheral edge of the first disk is an arcuate row of seven blocks 26, each block 26 having indicia in the form of an alphabetic character 28 inscribed therein. Each alphabetic character 28 is representative of a respective day of the week beginning with Sunday and progressing through to Saturday. More indicia, also in the form of alphabetic characters 30, is inscribed on the face of the first disk 20. These characters 30 appear in groups, each group representing one of the various months of the year. These groups may each appear alone on the face of the first disk 20 or may be assembled with other groups. The characters 30 representing the months of leap years may appear in a color distinguishable from the characters 30 representing the months of normal or non-leap years. Pointers or lead lines 32,32*a* are also inscribed on the face of the first disk 20. These lead lines 32,32*a* originate from each group or assembly of groups of characters 30. Each lead line 32,32*a* is provided with an outwardly and radially directed pointer which terminates at the peripheral edge of the first disk 20. The groups of characters 30 forming the months of January (JAN) and February (FEB) or the assembly of groups containing these months have leap year lead lines 32*a* originating therefrom which are distinguishable from the normal year 32 lead line by indicia forming the characters LY or by a distinguishing color.

The second disk 40 is concentrically and rotatably mounted behind the first disk 20, which is fixed. The second disk 40 also includes a face and a back. The first disk 20, being smaller than the second disk 40, leaves the outer peripheral edge portion of the face of the second disk 40 unobstructed from the first disk 20 and in plane view. The first disk 20 is opaque, preferably; of course, it could be translucent or even clear, if desired. Markings in the form of bullets 42 and dashed lines 44 appear on the face of the second disk 40 proximate the outer peripheral edge thereof and adjacent to the outer peripheral edge of the first disk 20. The bullets 42 and the dashed lines 44 are representative of leap year indicators and normal year indicators, respectively. These markings align with the radially projecting grid lines which form the columns of the grid 48. Every fifth marking is in the form of a bullet 42 which represents a leap year marking and the four markings or the dashed lines 44 between the leap year markings represent the normal year markings. Indicia in the form of numeric characters representing leap years 50 and normal years 52 are circumferentially disposed about the outer periphery of the second disk 40 and adjacent to respective leap year and normal year markings. The numerical characters 50,50, with the characters 52 corresponding to a leap year beginning adjacent to a bullet 42, ascend about the peripheral edge of the second disk 40 in yearly increments. Each numerical character 50,52 appears next to a bullet 42 or a dashed line 44 skipping every fourth dashed line 44 and beginning again at the next successive character 50 representing a leap year appearing adjacent to the next successive bullet 42. This particular embodiment shows a second set or table of corresponding markings 42,44 and numerical characters 50,52. It should be noted that the number of tables is not limited to one or two but may progress to even higher numbers thereof.

Figure 2:
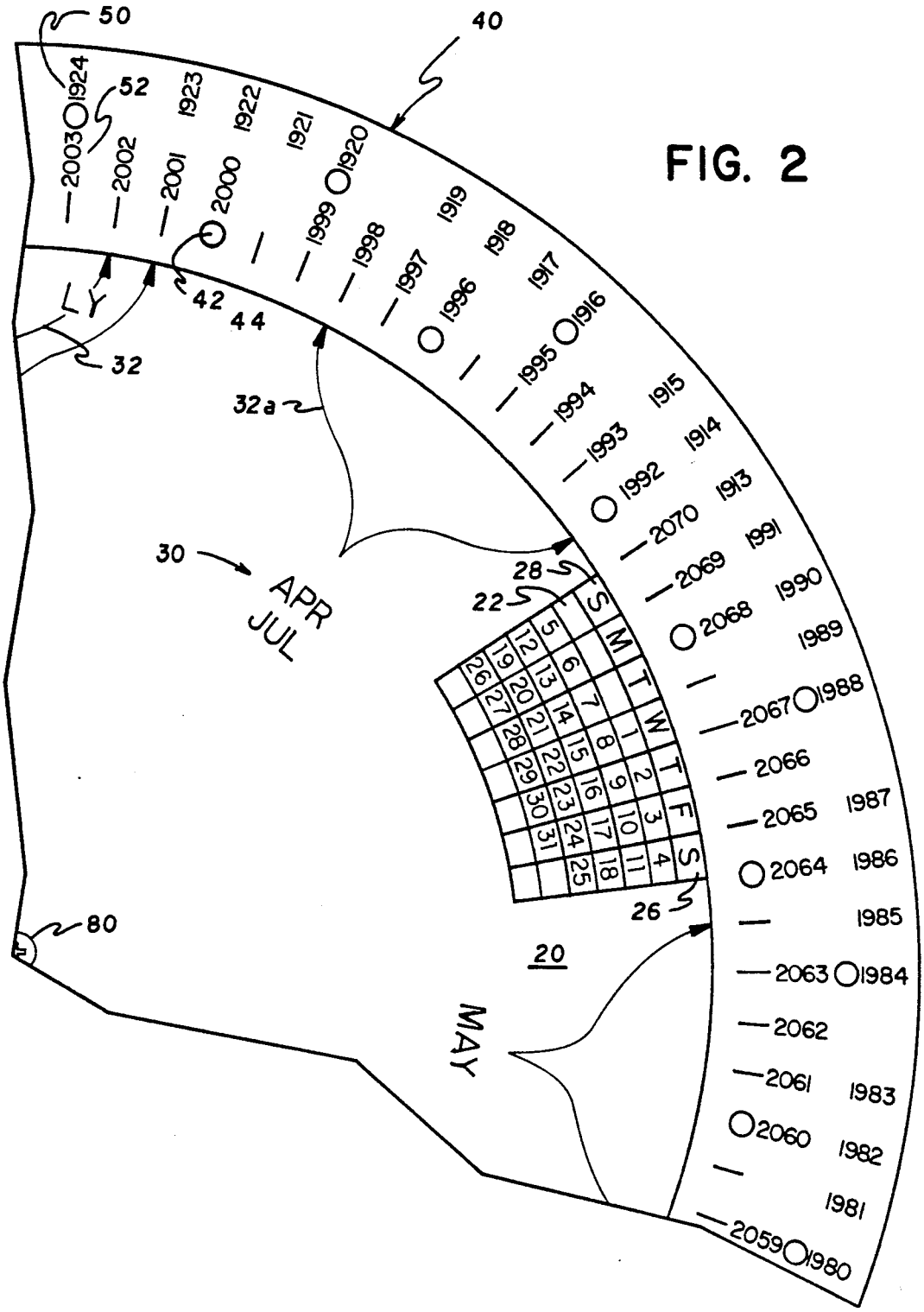
FIG. 2 is a partial front elevational view of the present invention, the view being rotated to the right with respect to FIG. 1, and drawn to an enlarged scale.

As shown in FIGS. 1 and 2, the lead lines 32, or the pointers thereof, are provided to correspondingly align with markings 42,44. In this embodiment, a pair of leap year lead lines 32 and normal year lead lines 32*a* are provided, one leap year and normal year lead lines 32,32*a* being separated from the other lead lines 32,32*a* of the same pair by eight markings. The second disk 40 is rotatable with respect to the first disk 20 to align a particular lead line 32,32*a* with specific marking 42,44, such as the lead lines 44 originating from the group of characters 30 forming the month of April, a calendar month can be viewed through the window 22. The alignment of one of the lead lines 32,32*a* will display through the window 22 a representation of a true, easily recognized calendar month, in Sunday through Saturday, day 1 through day 31 format. The alignment of the second lead line 32,32*a* of the same pair would display through the window 22 a representation of the dates which fall on the specific days of the week. However, while the representation would be that of a true calendar month, it would be more difficult to read since the days would appear in offset blocks, the first day number appearing at the upper left of the window being other than a "1".

To calibrate the calendar 10, simply orient a segment of grid 48 beneath window 22, such as the segment shown corresponding to April, 1992, which shows a correct arrangement of numerical characters 54 (see FIG. 3) to produce a true calendar month for a particular month of a particular year. A group of characters 30 denoting the corresponding month, such as the month of April as shown, and a lead line 32,32*a* originating from that group of characters 30 and terminating at a leap year or normal year marking 42,44 representing a corresponding year, such as the year 1992 as shown, is inscribed on the face of the first disk 20. This process is continued for each month of the year for at least one known leap year and normal year. Once this is accomplished, a table is constructed of the numerical characters 50,52 forming leap years and normal years in an ascending order about the outer peripheral edge of the second disk 40.

Figure 3:
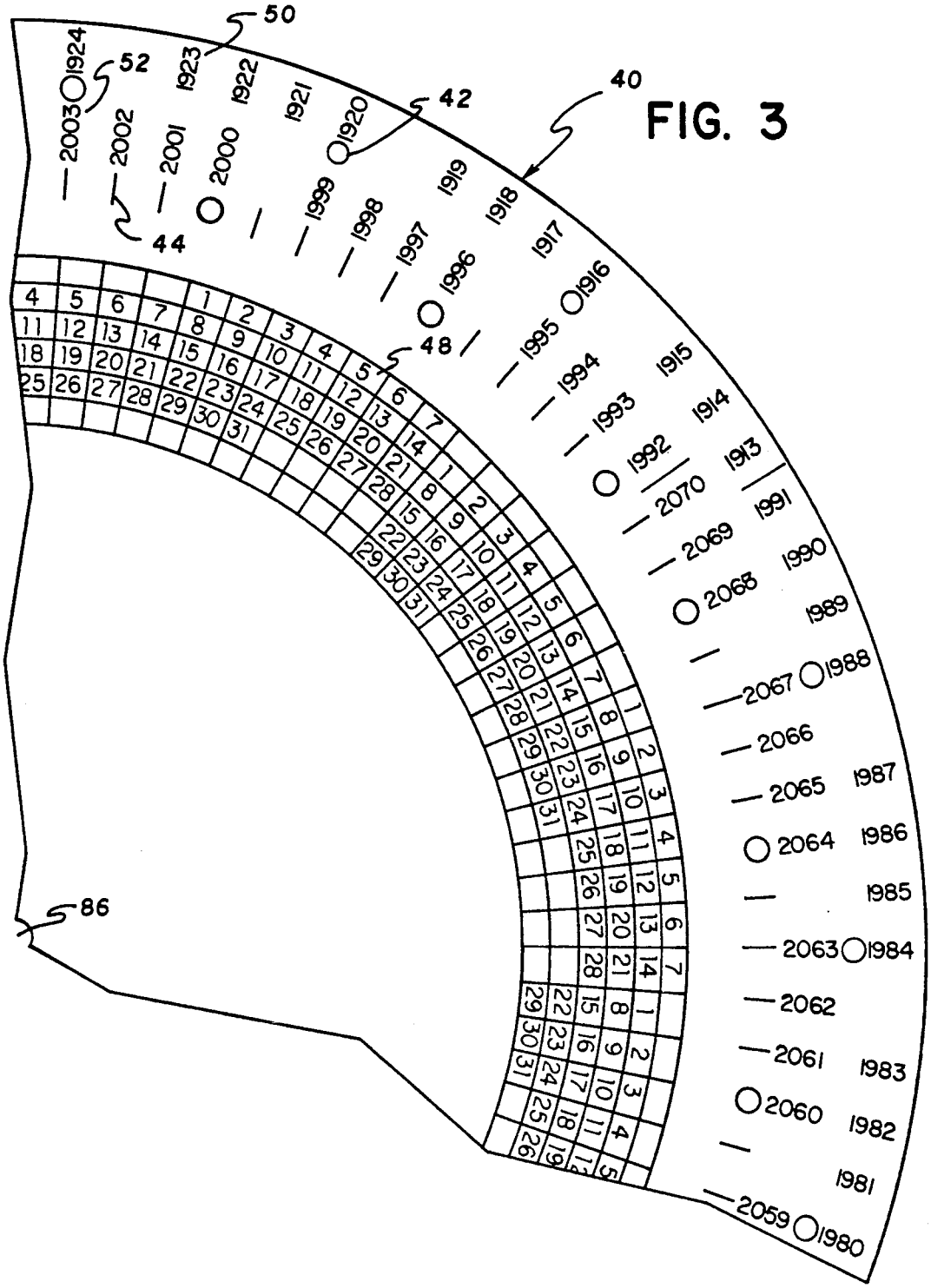
FIG. 3 is a partial front elevational view of the invention as shown in FIG. 2, with the top, first disk removed, so as to illustrate the face of the second disk.

As shown in FIG. 3, the grid 48 is formed from radially projecting columnar lines intersecting concentrically disposed circular lines to form a plurality of arcuate shaped blocks. Each numerical shaped block contains indicia in the form of one or more numerical characters 54 representing a calendar data. Note that these characters are arranged so as to produce a repeat pattern. The grid 48 consists of a matrix with six rows and eighty-four columns. The matrix includes seven pairs of first and second submatrices. The first submatrix and the second submatrix are alternatively arranged on the matrix. Each of the first and second submatrices includes dates from 1 to 31. The dates from 1 to 31 are arranged beginning with the dates 1–7 appearing in the first row of the six rows of the first submatrix and beginning with the dates 1–7 appearing in the second row of the six rows of the second submatrix. It should be noted that other patterns may be used and that the present invention is not limited to the specific patter shown.

Figure 5:
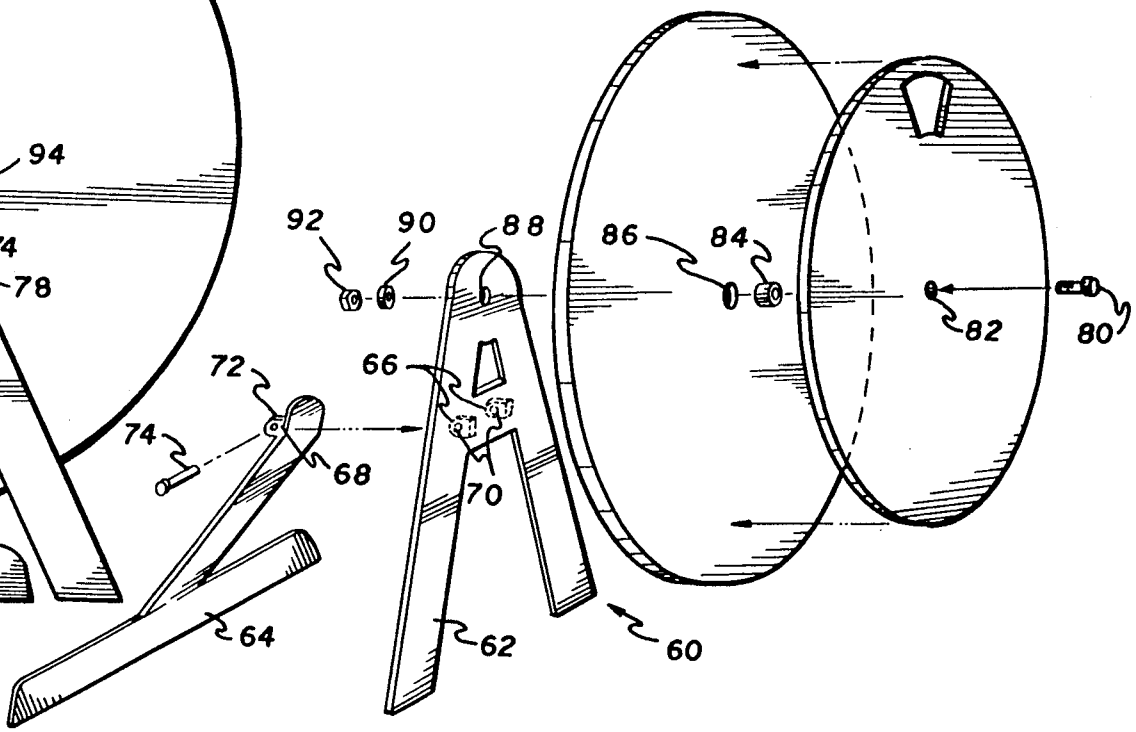
FIG. 5 is a front perspective view of the present invention.
Figure 4:
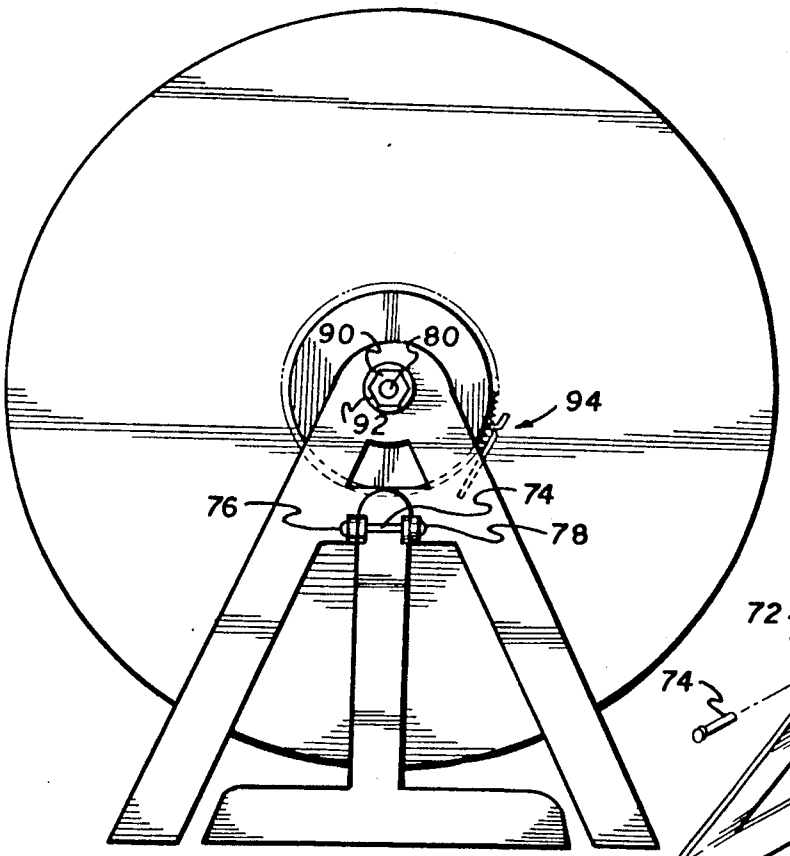
FIG. 4 is a rear elevational view of the present invention.

Finally, referring to FIGS. 4 and 5, the present invention is shown to include a stand 60. The stand 60 comprises an A-shaped member 62 pivotally engagable with an inverted T-shaped member 64. Tongues 66 protruding rearwardly from the top portion of the back of the A-shaped member 62 slidably contact corresponding tongues 68 directed rearwardly from the top portion of the T-shaped member 64. Apertures 70 in the tongues 66 of the A-shaped member 62 coalign with apertures 72 in the tongues 68 of the T-shaped member 64. A pin 74 passes through the apertures 70,72 to hold the tongues 66,68 in mutual engagement with one another. One end of the pin 74 is provided with a head 76 and the opposite end 78 is peened so as to maintain the tongues 66,68 in relative pivotal engagement. The stand 60 is fastened to the calendar 10 via the same fastener 80 which secures the first disk 20 and the second disk 40. The fastener passes through an aperture 82 centrally disposed in the first disk 20, through a bushing 84 located within a centrally disposed aperture 86 in the second disk 40, and further through an aperture 88 in the upper portion of the A-shaped member 62. A washer 90 and a nut 92 are applied to the fastener 80 holding the first disk 20, the second disk 40, and the stand 60 in assembly with one another. The present invention is not limited to this fastening arrangement and any suitable fastening arrangement may be substituted therefore. Moreover, the stand 60, through represented in each of the figures, is optional. It should be understood that the present invention may lie flat on a horizontal supporting surface or may be suspended from a vertical supporting surface (not shown).

Bushing 84 and aperture 86 are dimensionally related so that the second, interior, larger diameter disk is free to rotate relative to the outer, smaller diameter, first disk, with the window opening located uppermost. Alternatively, of course, the first disk could be rotatable and the second disk fixed, or both disks could be rotatably mounted. It is only important that the disks be rotatable relative to one another.

With further reference to FIG. 4, an incremental, click stop movement assembly 94 may be provided, for controlled, incremental movement of the second disk with respect to the first disk. The assembly could take any one of a variety of forms, and is shown here as including a toothed wheel fixed concentrically behind and to the larger disk, with a leaf spring having an outer catch leg riding along the periphery of the toothed wheel. The other end of the leaf spring may be mounted at any appropriate location on the support stand for the calendar disks.

It is to be understood that the present invention is not limited to the embodiments described above, but encompasses any and all embodiments within the scope of the following claims.

I claim:

1. A calendar comprising:

a first disk having a window and indicia, said indicia being adjacent to said window and indicating each day of a week, said first disk including;

month specifying means for specifying a predetermined month, and year selecting means, responsive to said month specifying means, for selecting, with respect to the predetermined month, a predetermined year from a list of a plurality of years; and a second disk, coupled concentrically to and rotatable relative to said first disk, which includes;

year table means containing said list of a plurality of years arranged so that said year selecting means can select the predetermined year, and day grid means listing dates from 1 to 31, said day grid circumferentially drawn about said second disk when said second disk is rotated relative to said first disk, said window being superimposed over the day grid, whereby when said month specifying means specifies the predetermined month and said year selecting means selects the predetermined year with respect to the predetermined month by means of said year table, said indicia and said window automatically define a calendar period corresponding to the predetermined month in the predetermined year, said calendar period appearing through said window.

2. The calendar according to claim 1, further comprising support means, coupled to said first disk and said second disk, for rotatably supporting said second disk and for supporting said first disk.

3. The calendar according to claim 1, wherein said month specifying means comprises indicia representing various months of a calendar year.

4. The calendar according to claim 3, wherein said month specifying means further comprises color coded indicia so that said various months can be visually discriminated from each other.

5. The calendar according to claim 1, wherein said month specifying means comprises indicia representing a period of months from January through December for a normal year, and January and February for a leap year.

6. The calendar according to claim 1, said year selecting means comprises a pointer, mounted on said first disk, which selects the predetermined year by pointing to the predetermined year.

7. The calendar according to claim 1, wherein said month specifying means comprises indicia representing various months of a calendar year, and wherein said year selecting means comprises a plurality of pointers, appearing on said first disk, each of which points to a one of said plurality of years, each of said pointers being coupled to a corresponding one of said various months.

8. The calendar according to claim 1, wherein said year specifying means comprises:

a leap-year pointer, mounted on said first disk, which selects the predetermined year when the predetermined year corresponds to a leap year; and a normal-year pointer, mounted on said first disk, which selects the predetermined year when the predetermined year corresponds to a normal year.

9. The calendar according to claim 8, wherein said year specifying means including color coding said leap-year pointer and said normal-year pointer so that said leap-year pointer can be visually discriminated from said normal-year pointer.

10. The calendar according to claim 1, wherein said year table includes color coding said plurality of years such that a year corresponding to a leap year and a year corresponding to a normal year can be visually discriminated from the normal years.

11. The calendar according to claim 1, wherein said day grid is formed so that the calendar period defined by said window can be comprised of a matrix with six rows and seven columns in which the dates from 1 to 31 are assigned.

12. The calendar according to claim 1, wherein said first and second disks each further include an outer circumference and said second disk is larger than said first disk, said year table being disposed between said outer circumference of said first disk and said outer circumference of said second disk.

13. The calendar according to claim 1, wherein said plurality of years includes a leap year and a normal year and said year table includes means for discriminating said leap year and said normal year.

14. The calendar according to claim 1, wherein said day grid comprises a matrix with six rows and eighty-four columns circumferentially arranged on the second disk, said matrix consisting of seven pairs of a first submatrix and a second submatrix, each submatrix having six rows and seven columns, said dates from 1 to 31 being assigned to said first submatrix from beginning with dates 1 to 7 of said dates 1 to 31 in a first row of said six rows thereof, and said second submatrix beginning with dates 1 to 7 of said dates 1 to 31 in a first row of said six rows thereof.

15. The calendar according to claim 2, wherein said support means comprises:

a shaft, perforating through each center of said first disk and said second disk;

an A-shaped member having two oblique portions and one traverse portion, a point crossed by said two oblique portions being coupled perpendicularly to said shaft; and an inverted T-shaped member having a longitudinal portion and a traverse portion perpendicular to said longitudinal portion, said longitudinal portion being inserted into an aperture formed by said two oblique portions and one traverse portion of said A-shaped member.

16. The calendar according to claim 15, wherein said support means further comprises means for slanting inverted T-shaped member relative to said A-shaped member.

17. The calendar according to claim 1, wherein said first disk is fixed and said second disk is rotatable with respect to said first disk, there further being means providing for click stop, controlled incremental movement of said second disk with respect to said first disk.

* * * * *